US009630800B2

(12) United States Patent
Daniell

(10) Patent No.: US 9,630,800 B2
(45) Date of Patent: Apr. 25, 2017

(54) FILAMENT STORAGE AND DISPENSING ASSEMBLY

(71) Applicant: Byver Daniell, Plant City, FL (US)

(72) Inventor: Byver Daniell, Plant City, FL (US)

( * ) Notice: Subject to any disclaimer, the term of this patent is extended or adjusted under 35 U.S.C. 154(b) by 348 days.

(21) Appl. No.: 14/308,806

(22) Filed: Jun. 19, 2014

(65) Prior Publication Data

US 2015/0368065 A1 Dec. 24, 2015

(51) Int. Cl.

| | |
|---|---|
| ***B65H 49/32*** | (2006.01) |
| ***B65H 49/20*** | (2006.01) |
| ***B65H 75/16*** | (2006.01) |
| ***B65H 57/06*** | (2006.01) |

(52) U.S. Cl.

CPC ..... *B65H 49/322* (2013.01); *B65H 49/205* (2013.01); *B65H 57/06* (2013.01); *B65H 75/16* (2013.01); *B65H 2701/35* (2013.01); *B65H 2701/355* (2013.01)

(58) Field of Classification Search

CPC ..... B65H 49/08; B65H 49/10; B65H 49/14; B65H 49/205; B65H 49/322; B65H 75/16; B65H 75/40; B65H 75/406; B65H 75/4471; B65H 75/4473; B65H 57/06

See application file for complete search history.

(56) References Cited

U.S. PATENT DOCUMENTS

| | | | | |
|---|---|---|---|---|
| 1,433,356 | A | 10/1922 | Edwards | |
| 3,612,427 | A * | 10/1971 | Bishop | A01K 97/06 242/137.1 |
| 3,962,815 | A | 6/1976 | Christensen | |
| 4,026,063 | A | 5/1977 | Allen et al. | |
| 4,141,479 | A | 2/1979 | Dennison | |
| 4,290,223 | A | 9/1981 | Ostenberg et al. | |
| 4,787,168 | A | 11/1988 | Benit et al. | |
| 4,998,685 | A | 3/1991 | Spencer | |
| D367,575 | S | 3/1996 | Thompson | |
| 5,544,442 | A | 8/1996 | Perkins | |
| 6,694,667 | B2 | 2/2004 | Davis | |
| 2007/0125897 | A1* | 6/2007 | Wijerama | B65D 5/4295 242/171 |
| 2011/0084160 | A1* | 4/2011 | Therrell | B65H 49/322 242/588.3 |

* cited by examiner

*Primary Examiner* — William E Dondero

(57) ABSTRACT

A filament storage and dispensing assembly stores and dispenses filament, such as fishing line, thread or the like. The assembly includes a container having a closed end, an open end and a perimeter wall coupled to and extending between the closed end and the open end. The open end defines an access opening into an interior space of the container. A spool is positionable in the interior space of the container. Filament is rotatably mounted around the spool for storing the filament in a coiled manner on the spool. A hole is positioned in the perimeter wall of the container. A free end of the filament is extendable through the hole for dispensing the filament outwardly of the container. A container lid is removably couplable to the open end of the container and is positionable to close the access opening of the container.

7 Claims, 4 Drawing Sheets

FILAMENT STORAGE AND DISPENSING ASSEMBLY

BACKGROUND OF THE DISCLOSURE

Field of the Disclosure

The disclosure relates to container devices and more particularly pertains to a new container device for storing and dispensing filament, such as fishing line, thread or the like.

SUMMARY OF THE DISCLOSURE

An embodiment of the disclosure meets the needs presented above by generally comprising a container having a closed end, an open end and a perimeter wall coupled to and extending between the closed end and the open end. The open end defines an access opening into an interior space of the container. A spool is positionable in the interior space of the container. Filament is rotatably mounted around the spool for storing the filament in a coiled manner on the spool. A hole is positioned in the perimeter wall of the container. A free end of the filament is extendable through the hole for dispensing the filament outwardly of the container. A container lid is removably couplable to the open end of the container and is positionable to close the access opening of the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
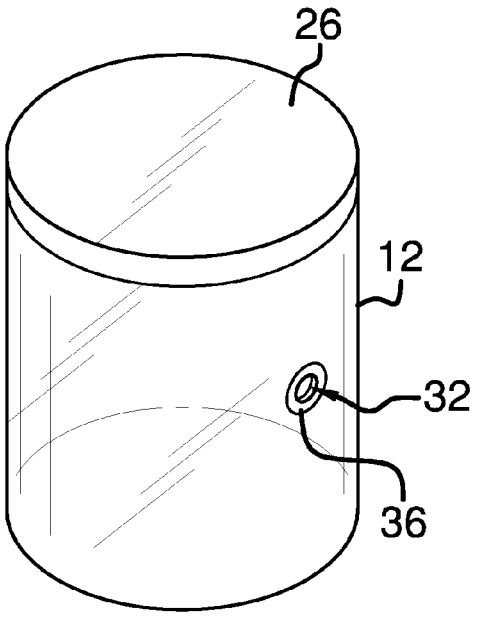
FIG. 1 is a top front side perspective view of a filament storage and dispensing assembly according to an embodiment of the disclosure.
Figure 2:
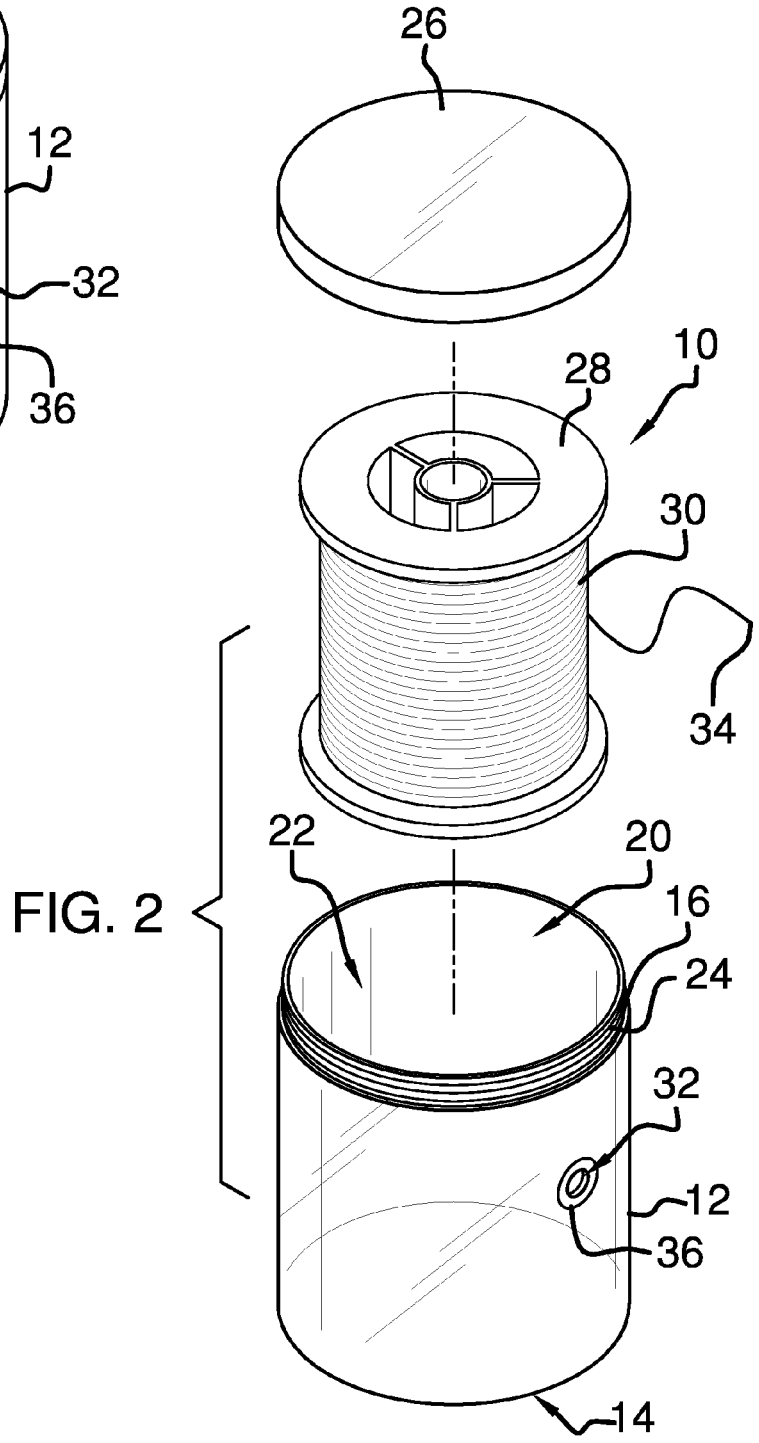
FIG. 2 is an exploded top front side perspective view of an embodiment of the disclosure.
Figure 3:
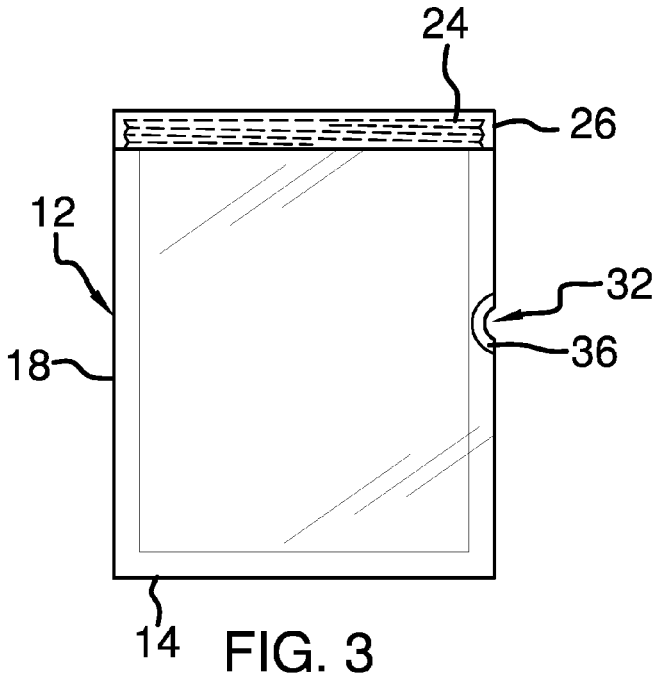
FIG. 3 is a side view of an embodiment of the disclosure.

With reference now to the drawings, and in particular to FIGS. 1 through 6 thereof, a new container device embodying the principles and concepts of an embodiment of the disclosure and generally designated by the reference numeral 10 will be described.

As best illustrated in FIGS. 1 through 6, the filament storage and dispensing assembly 10 generally comprises a container 12 having a closed end 14, an open end 16 and a perimeter wall 18 coupled to and extending between the closed end 14 and the open end 16. The open end 16 defines an access opening 20 into an interior space 22 of the container 12. The container 12 may be transparent to permit viewing into the interior space 22 of the container 12. A container lid 26 is removably couplable to the open end 16 of the container 12 and is positionable to close the access opening 20 of the container 12. A threaded neck 24 may be attached to the container 12 and may extend around the access opening 20 of the container 12 such that the container lid 26 is threadably coupled to the threaded neck 24. The container 12 is comprised of a rigid material, such as plastic, metal or the like.

A spool 28 is positionable in the interior space 22 of the container 12. Filament 30, such as fishing line, thread or the like, is coiled around the spool 28. A hole 32 is positioned in the perimeter wall 18 of the container 12. A free end 34 of the filament 30 is extendable through the hole 32 for dispensing the filament 30 outwardly of the container 12. A grommet 36 may be coupled to the container 12, and more particularly, may extend around the hole 32 for providing reinforcement to the hole 32.

Figure 4:
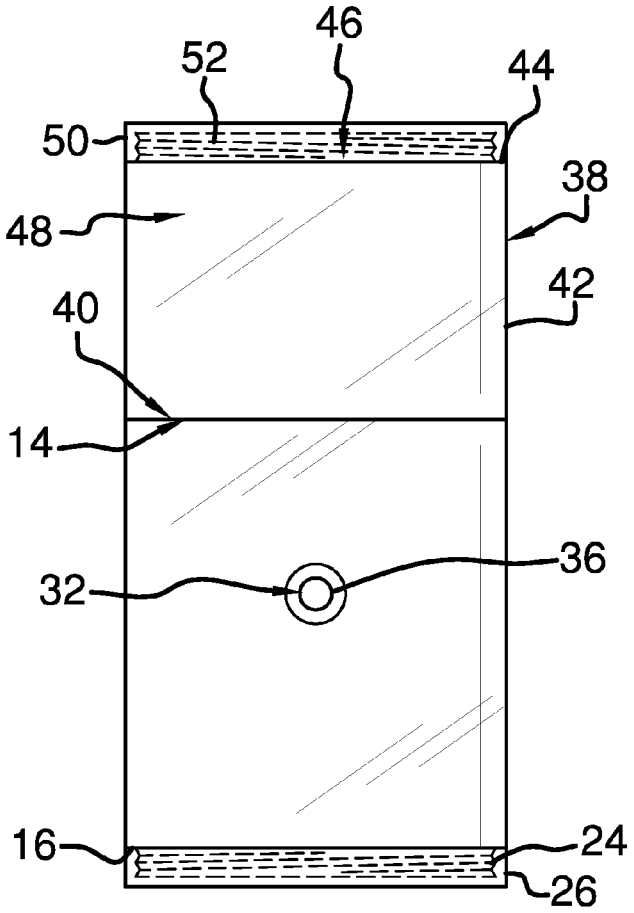
FIG. 4 is a front view of an alternative embodiment of the disclosure.

An alternative embodiment of the invention is shown in FIG. 4 wherein a compartment 38 is coupled to the closed end 14 of the container 12 such that the closed end 14 of the container 12 defines a bottom 40 of the compartment 38. The closed end 14 of the container 12 is the same as that shown in FIGS. 1, 2 and 3. The compartment 38 further includes a peripheral wall 42 coupled to and extending upwardly from the bottom 40 of the compartment 38. A top edge 44 of the compartment 38 defines an access opening 46 into an interior space 48 of the compartment 38. The compartment 38 may be transparent to permit viewing into the interior space 48 of the compartment 38. A compartment lid 50 is removably couplable to the top edge 44 of the compartment 38 and is positionable to close the access opening 46 of the compartment 38. A threaded lip 52 may be attached to the compartment 38 and may extend around the access opening 46 of the compartment 38 such that the compartment lid 50 is threadably coupled to the threaded lip 52.

Figure 5:
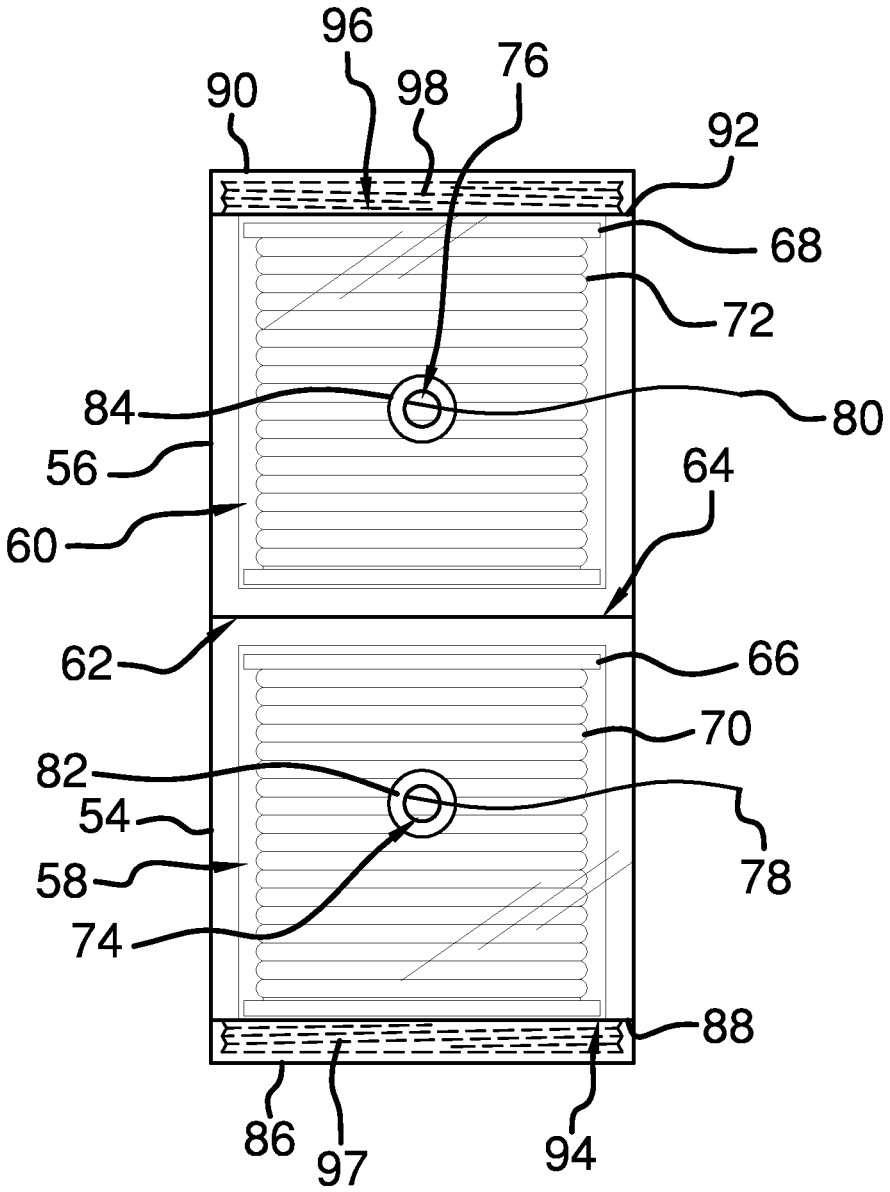
FIG. 5 is a front view of yet another alternative embodiment of the disclosure.
Figure 6:
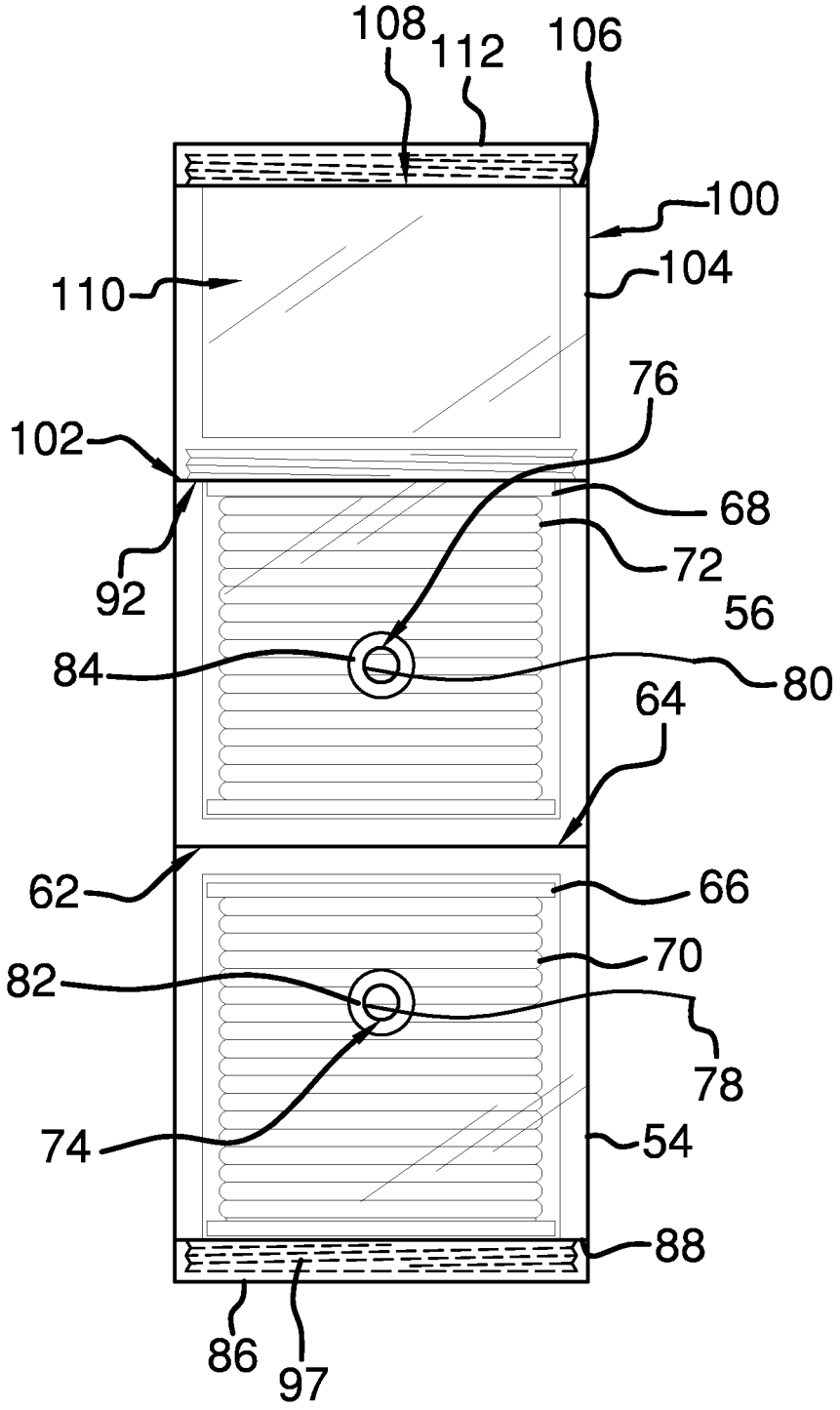
FIG. 6 is a front view of a further alternative embodiment of the disclosure.

Two additional alternative embodiments are shown in FIGS. 5 and 6 wherein the container 12 is one of a pair of containers that includes a first container 54 and a second container 56 coupled together. Each of the first 54 and second 56 containers is identical to container 12. Thus, each of the first 54 and second 56 containers may be transparent to permit viewing into the interior space 58, 60 of the first 54 and second 56 containers. Closed ends 62, 64 of the first 54 and second 56 containers may abut each other. The spool 28 may be one of a pair of spools including a first spool 66 and a second spool 68. The first spool 66 is positionable in the interior space 58 of the first container 54. The second spool 68 is positionable in the interior space 60 of the second container 56. The filament 30 may also be one of a pair of filaments. The pair of filaments 30 may include a first filament 70 coiled around the first spool 66 and a second filament 72 coiled around the second spool 68. The hole 32 is one of a pair of holes. The pair of holes 32 includes a first hole 74 positioned in the perimeter wall 18 of the first container 54 and a second hole 76 positioned in the perimeter wall 18 of the second container 56. A free end 78 of the first filament 70 is extendable through the first hole 74 for dispensing the first filament 70 outwardly of the first container 54. A free end 80 of the second filament 72 is extendable through the second hole 76 for dispensing the second filament 72 outwardly of the second container 56. The grommet 36 may be one of a pair of grommets including a first grommet 82 coupled to the first container 54 extending around the first hole 74 for providing reinforcement to the first hole 74 and a second grommet 84 coupled to the second container 56 extending around the second hole 76 for providing reinforcement to the second hole 76.

As shown in the embodiment of FIG. 5, the container lid 26 may be one of a pair of container lids. The pair of the container lids 26 includes a first container lid 86 removably couplable to an open end 88 of the first container 54 and a second container lid 90 removably couplable to an open end 92 of the second container 56. The first container lid 86 is positionable to close an access opening 94 of the first container 54. The second container lid 90 is positionable to close an access opening 96 of the second container 56. A first threaded neck 97 may be attached to the first container 54 extending around the access opening 94 of the first container 54 such that the first container lid 86 is threadably coupled to the first threaded neck 97. Similarly, a second threaded neck 98 may be attached to the second container 56 extending around the access opening 96 of the second container 56 such that the second container lid 90 is threadably coupled to the second threaded neck 98.

The embodiment in FIG. 6 is a combination of elements taken from the embodiments in FIGS. 4 and 5. Similar to FIG. 5, FIG. 6 shows the first container 86 and the second container 56 coupled together and the first container lid 86 removably couplable to the open end 88 of the first container 54. However, instead of the second container lid 90, the embodiment in FIG. 6 includes a compartment 100 similar to the compartment 38 shown in the embodiment of FIG. 4. The compartment 100 includes a closed bottom end 102 and a peripheral wall 104 coupled to and extending upwardly from the closed bottom end 102. A top edge 106 of the compartment 100 defines an access opening 108 into an interior space 110 of the compartment 100. A compartment lid 112 is removably couplable to the top edge 106 of the compartment 100 and is positionable to close the access opening 108 of the compartment 100. The compartment 100 is coupled to the open end 92 of the second container 56 such that each of the compartment 100, the first container 54 and the second container 56 are vertically stacked relative to each other. In particular, the compartment 100 may be threadably coupled to the open end 92 of the second container 56.

Each container 12 may have a height extending from the closed end 14 to the open end 16 that measures between approximately 6.5 cm and 8.5 cm. In this manner, each container 12 should have dimensions capable of holding a quarter pound spool of standard fishing line. Each compartment 38, 100 may have a height between approximately 2.0 cm and 3.5 cm as measured from top edge 44 to bottom 40 and from top edge 106 to closed bottom end 102.

In use, spool 28 is positioned in the container 12 through the open end 16. Filament 30, such as fishing line, thread or the like, that is coiled around the spool 28 is threaded through the hole 32. The container lid 26 is then coupled to the open end 16 of the container 12 and the filament is dispensed outwardly through the hole 32 by pulling on the free end 34 of the filament 30. The container lid 26 is removed and the spool 28 is replaced as needed. In this manner, the assembly 10 provides a convenient way to store, protect and dispense filament 30. The alternative embodiments permit the assembly 10 to hold one or two spools 28 and to provide a compartment 34, 100 for storing accessories related to the particular filament 30 being stored.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A filament storage and dispensing assembly comprising:

a container having a closed end, an open end and a perimeter wall coupled to and extending between said closed end and said open end, said open end defining an access opening into an interior space of said container;

a spool positionable in said interior space of said container, filament being coiled around said spool;

a hole positioned in said perimeter wall of said container, a free end of said filament being extendable through said hole for dispensing said filament outwardly of said container;

a container lid removably couplable to said open end of said container, said container lid being positionable to close said access opening of said container;

a compartment coupled to said closed end of said container such that said closed end of said container defines a bottom of said compartment, said compartment further including a peripheral wall coupled to and extending upwardly from said bottom of said compartment, a top edge of said compartment defining an access opening into an interior space of said compartment; and a compartment lid removably couplable to said top edge of said compartment, said compartment lid being positionable to close said access opening of said compartment.

2. The assembly of claim 1, further comprising a grommet coupled to said container and extending around said hole for providing reinforcement to said hole.

3. The assembly of claim 1, further comprising said container being transparent to permit viewing into said interior space of said container.

4. The assembly of claim 1, further comprising a threaded neck being attached to said container and extending around said access opening of said container, said container lid being threadably coupled to said threaded neck.

5. The assembly of claim 1, further comprising a threaded lip being attached to said compartment and extending around said access opening of said compartment, said compartment lid being threadably coupled to said threaded lip.

6. The assembly of claim 1, further comprising said compartment being transparent to permit viewing into said interior space of said compartment.

7. A filament storage and dispensing assembly comprising:

a container having a closed end, an open end and a perimeter wall coupled to and extending between said closed end and said open end, said open end defining an access opening into an interior space of said container, said container being transparent to permit viewing into said interior space of said container, a threaded neck being attached to said container and extending around said access opening of said container;

a spool positionable in said interior space of said container, filament being coiled around said spool;

a hole positioned in said perimeter wall of said container, a free end of said filament being extendable through said hole for dispensing said filament outwardly of said container;

a container lid removably couplable to said open end of said container, said container lid being positionable to close said access opening of said container, said container lid being threadably coupled to said threaded neck;

a grommet coupled to said container and extending around said hole for providing reinforcement to said hole;

a compartment coupled to said closed end of said container such that said closed end of said container defines a bottom of said compartment, said compartment further including a peripheral wall coupled to and extending upwardly from said bottom of said compartment, a top edge of said compartment defining an access opening into an interior space of said compartment, said compartment being transparent to permit viewing into said interior space of said compartment;

a compartment lid removably couplable to said top edge of said compartment, said compartment lid being positionable to close said access opening of said compartment; and a threaded lip being attached to said compartment and extending around said access opening of said compartment, said compartment lid being threadably coupled to said threaded lip.

* * * * *